US010037649B2

(12) United States Patent
Fong

(10) Patent No.: US 10,037,649 B2
(45) Date of Patent: Jul. 31, 2018

(54) METHOD OF GAMING, A GAMING SYSTEM AND A GAME CONTROLLER

(71) Applicant: Aristocrat Technologies Australia Pty Limited, North Ryde (AU)

(72) Inventor: Colin Fong, Penshurst (AU)

(73) Assignee: ARISTOCRAT TECHNOLOGIES AUSTRALIA PTY LTD. (AU)

( * ) Notice: Subject to any disclaimer, the term of this patent is extended or adjusted under 35 U.S.C. 154(b) by 230 days.

(21) Appl. No.: 14/849,249

(22) Filed: Sep. 9, 2015

(65) Prior Publication Data

US 2017/0011582 A1 Jan. 12, 2017

(30) Foreign Application Priority Data

Jun. 3, 2015 (AU) ..... 2015902176

(51) Int. Cl.
*G07F 17/34* (2006.01)
*G07F 17/32* (2006.01)
*A63F 9/24* (2006.01)

(52) U.S. Cl.
CPC ..... *G07F 17/3213* (2013.01); *A63F 9/24* (2013.01); *G07F 17/34* (2013.01); *A63F 2009/2457* (2013.01)

(58) Field of Classification Search
CPC ..... A63F 2009/2457; A63F 9/24; G07F 17/3213; G07F 17/34; G07F 17/3244; G07F 17/326; G07F 17/3267
See application file for complete search history.

(56) References Cited

U.S. PATENT DOCUMENTS 9,361,763 B1 * 6/2016 Aoki ..... G07F 17/34
2012/0115570 A1 * 5/2012 Collette ..... G07F 17/326 463/20
2013/0102375 A1 * 4/2013 Aoki ..... G07F 17/32 463/20
2015/0105138 A1 * 4/2015 Delekta ..... G07F 17/3213 463/20
2015/0287269 A1 * 10/2015 Berman ..... G07F 17/326 463/20

* cited by examiner

*Primary Examiner* — Justin Myhr
(74) *Attorney, Agent, or Firm* — McAndrews, Held & Malloy, Ltd.

(57) ABSTRACT

A gaming system comprising: a display for displaying selected symbols in a plurality of columns of display positions corresponding to respective one of a plurality of reels; a random number generator; a memory storing reel strip data for each of the reels, the reel strip data specifying a sequence of reel strip positions and a symbol associated with each reel strip position, the reel strip data of a reel of the plurality of reels including expansion data associated with a reel strip position, the expansion data defining an expansion to apply to the reel strip and a probability that the expansion will be applied, the expansion defining a number of reel strip positions to be added to the reel strip, each added reel strip position having the same symbol as the symbol position with which the expansion data is associated; and a game controller.

29 Claims, 7 Drawing Sheets

| Position | Reel 1 |
|---|---|
| 1 | A |
| 2 | A |
| 3 | A |
| 4 | K |
| 5 | Q |
| 6 | 10 |
| 7 | Pic 1 |
| 8 | J |
| 9 | Q |
| 10 | A |
| 11 | A |
| 12 | A |
| 13 | A |
| 14 | 10 |
| 15 | K |
| 16 | Q |
| 17 | 10 |
| 18 | Pic 1 |
| 19 | J |
| 20 | Q |
| 21 | A |
| 22 | Pic2 |
| 23 | 9 |
| 24 | 10 |
| 25 | Q |

Figure 8A

| Position | Reel 1 |
|---|---|
| 1 | A |
| 2 | K |
| 3 | Q |
| 4 | 10 |
| 5 | Pic 1 |
| 6 | J |
| 7 | Q |
| 8 | A |
| 9 | 10 |
| 10 | K |
| 11 | Q |
| 12 | 10 |
| 13 | Pic 1 |
| 14 | J |
| 15 | Q |
| 16 | A |
| 17 | Pic2 |
| 18 | 9 |
| 19 | 10 |
| 20 | Q |

Figure 8B

| Position | Reel 1 |
|---|---|
| 1 | A |
| 2 | A |
| 3 | A |
| 4 | K |
| 5 | Q |
| 6 | 10 |
| 7 | Pic 1 |
| 8 | J |
| 9 | Q |
| 10 | A |
| 11 | A |
| 12 | A |
| 13 | A |
| 14 | 10 |
| 15 | K |
| 16 | Q |
| 17 | 10 |
| 18 | Pic 1 |
| 19 | J |
| 20 | Q |
| 21 | A |
| 22 | Pic2 |
| 23 | 9 |
| 24 | 10 |
| 25 | Q |

METHOD OF GAMING, A GAMING SYSTEM AND A GAME CONTROLLER

RELATED APPLICATIONS

This application claims priority to Australian Provisional Patent Application No. 2015902176 having an International filing date of Jul. 9, 2015, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Spinning reel type gaming machines are known wherein the reel strips have a number of the same symbol arranged in a "stack" on at least one of the reels, for example, a stack of three or four of the same symbol. Such stacks have the potential to contribute to a large number of winning symbol combinations, for example, if the symbols selected by the game controller for two of the reels are those of a stack, it is more likely that the other selected symbols will combine with the stacked symbols to form winning combinations.

While such gaming machines provide players with enjoyment, a need exists for alternative gaming systems that operate in a different manner.

BRIEF SUMMARY OF THE INVENTION

In a first aspect, the invention provides a gaming system comprising:

a display for displaying selected symbols in a plurality of columns of display positions corresponding to respective one of a plurality of reels;

a random number generator;

a memory storing reel strip data for each of the reels, the reel strip data specifying a sequence of reel strip positions and a symbol associated with each reel strip position, the reel strip data of a reel including expansion data associated with a reel strip position, the expansion data defining an expansion to apply to the reel strip and a probability that the expansion will be applied, the expansion defining a number of reel strip positions to be added to the reel strip, each added reel strip position having the same symbol as the symbol position with which the expansion data is associated; and a game controller configured to:

employ the random number generator to determine based on the expansion data whether to apply the expansion, and upon determining to apply the expansion:

add the number of reel strip positions between the symbol position and at least one neighbouring reel strip position to form an expanded reel strip, select symbols from the reel strips including the expanded reel strip using the random number generator, control the display to display the selected symbols in the display positions, and make an award upon the selected symbols including one or more winning symbol combinations.

In an embodiment, the game controller is configured to control the display to display at least part of the reel strip as expanding on the display upon a symbol being selected from an expanded portion of the reel strip.

In an embodiment, the expansion data of the symbol positions defines a plurality of expansions, each expansion defining a different number of reel strip positions to be added to the reel strip.

In an embodiment wherein different probabilities are associated with at least two of the expansions.

In an embodiment, there are a plurality of items of expansion data associated with respective ones of a plurality of reel strip positions of the reel.

In an embodiment, at least two of the plurality of items of expansion data are different.

In an embodiment, the reel strip data of the plurality of reels includes expansion data associated with reel strip positions of the respective reels.

8. A gaming system of any one of claims 3 to 7, wherein the game controller is configured to employ the random number generator to determine based on the expansion data whether to apply each expansion.

In an embodiment, the game controller is configured to employ the random number generator to determine based on the expansion data whether to apply each expansion for which an expansion condition is met.

In a second aspect, the invention provides an electronic method of gaming comprising:

storing reel strip data for each of a plurality of reels, the reel strip data specifying a sequence of reel strip positions and a symbol associated with each reel strip position, the reel strip data of a reel including expansion data associated with a reel strip position, the expansion data defining an expansion to apply to the reel strip and a probability that the expansion will be applied, the expansion defining a number of reel strip positions to be added to the reel strip, each added reel strip position having the same symbol as the symbol position with which the expansion data is associated; and employing a random number generator to determine based on the expansion data whether to apply the expansion, and upon determining to apply the expansion:

adding the number of reel strip positions between the symbol position and at least one neighbouring reel strip position to form an expanded reel strip, selecting symbols from the reel strips including the expanded reel strip using the random number generator, controlling the display to display the selected symbols in a plurality of columns of display positions corresponding to respective one of the plurality of reels, and making an award upon the selected symbols including one or more winning symbol combinations.

In a third aspect, the invention provides a game controller for a gaming system, the game controller configured to:

retrieve data from a memory storing reel strip data for each of a plurality of reels, the reel strip data specifying a sequence of reel strip positions and a symbol associated with each reel strip position, the reel strip data of a reel including expansion data associated with a reel strip position, the expansion data defining an expansion to apply to the reel strip and a probability that the expansion will be applied, the expansion defining a number of reel strip positions to be added to the reel strip, each added reel strip position having the same symbol as the symbol position with which the expansion data is associated;

employ a random number generator to determine based on the expansion data whether to apply the expansion, and upon determining to apply the expansion:

add the number of reel strip positions between the symbol position and at least one neighbouring reel strip position to form an expanded reel strip, select symbols from the reel strips including the expanded reel strip using the random number generator, control the display to display the selected symbols in a plurality of columns of display positions corresponding to respective one of the plurality of reels, and make an award upon the selected symbols including one or more winning symbol combinations.

In a fourth aspect, the invention provides computer program code which when executed implements the above method.

In a fifth aspect, the invention provides a tangible computer readable medium comprising the above program code.

BRIEF DESCRIPTION OF SEVERAL VIEWS OF THE DRAWINGS

An exemplary embodiment of the invention will now be described with reference to the accompanying drawings in which:

FIGS. 8A and 8B illustrate an example modification of a reel strip.

DETAILED DESCRIPTION OF THE INVENTION

Figure 1:
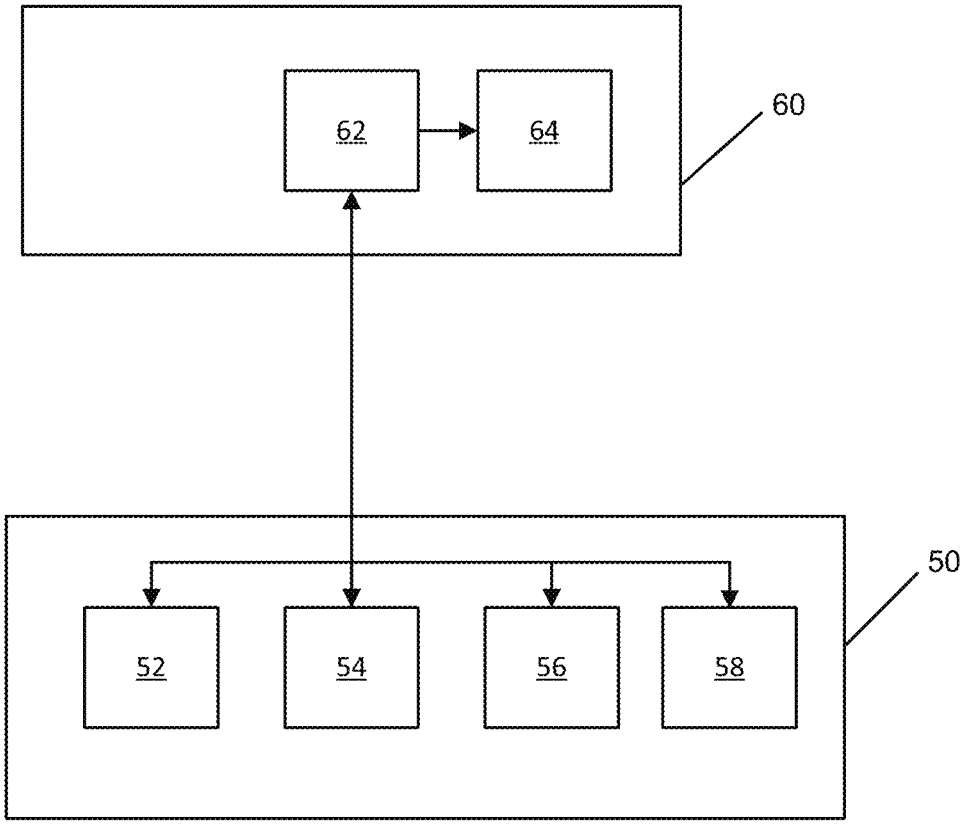
FIG. 1 is a block diagram of the core components of a gaming system.

Referring to the drawings, there is shown a gaming system having a game controller having components that enable the implementation of a game where one or more of the reel strips dynamically expand, such that when the reel strip expands, there is a stack of symbols in the reel strip. In an embodiment, the reels strips expand by different amounts depending on a random outcome such that the stacks are of different sizes depending on the random outcome. An advantage of embodiments of the invention is that it allows the implementation of games where the make-up of the reel strips is different from game to game and stacks of different symbols can be added to the reel strips.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
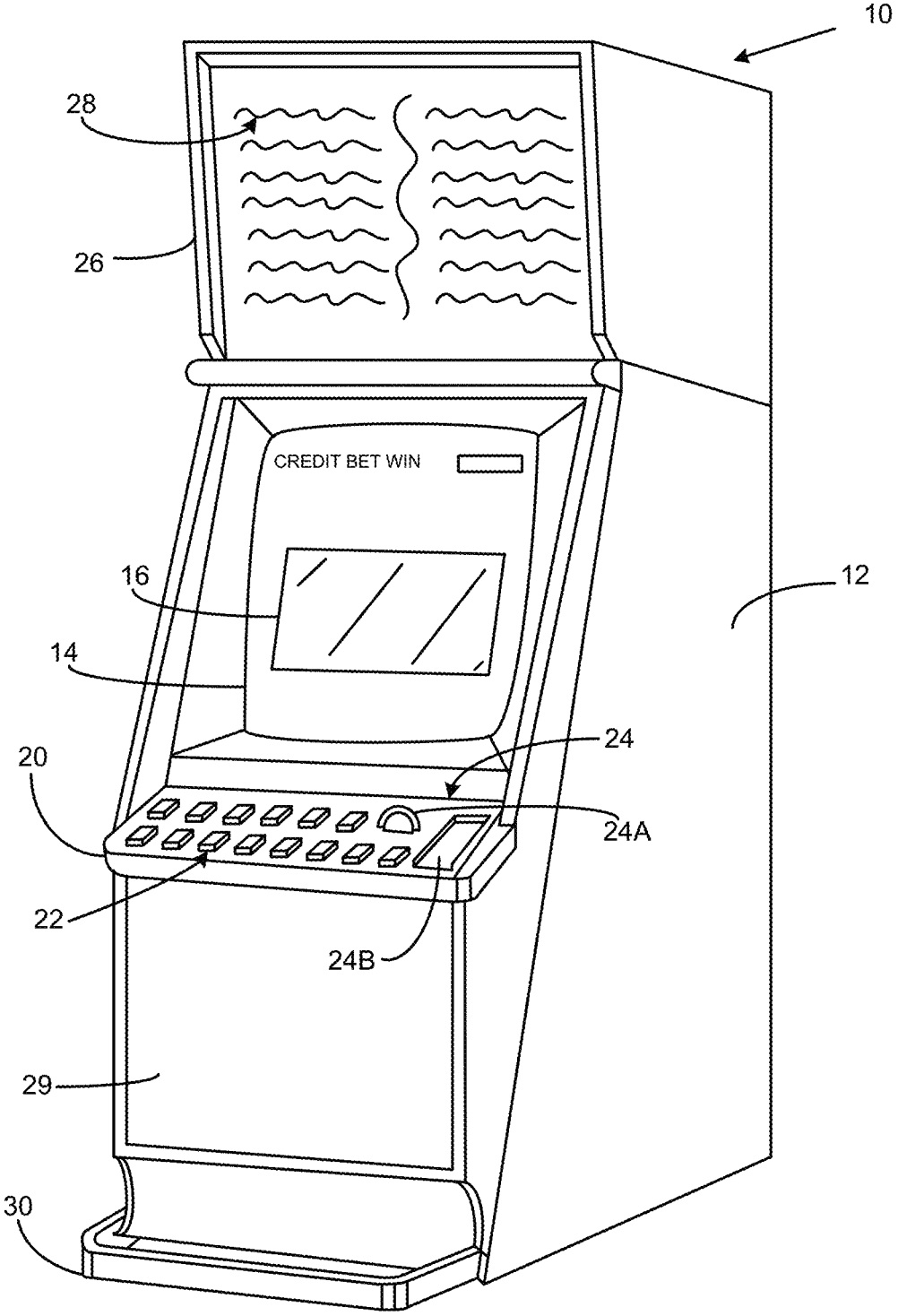
FIG. 2 is a perspective view of a stand alone gaming machine.

A gaming system in the form of a standalone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module that is accessed in response to insertion of the player tracking device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a liquid crystal display. The display 14 may any other suitable video display unit, such as an OLED display. The top box 26 may also include a display, which may be of the same type as the display 14, or of a different type.

Figure 3:
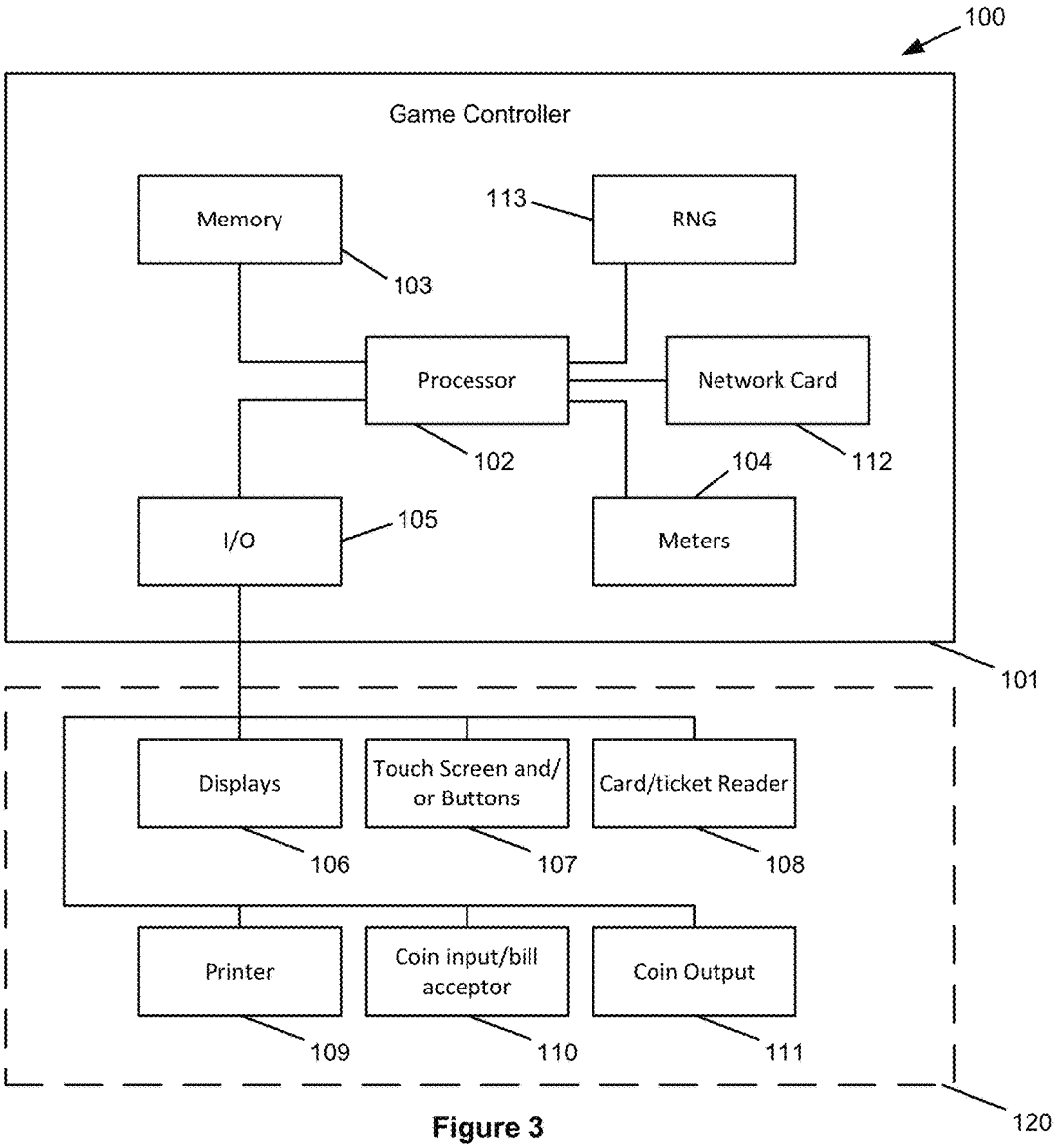
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
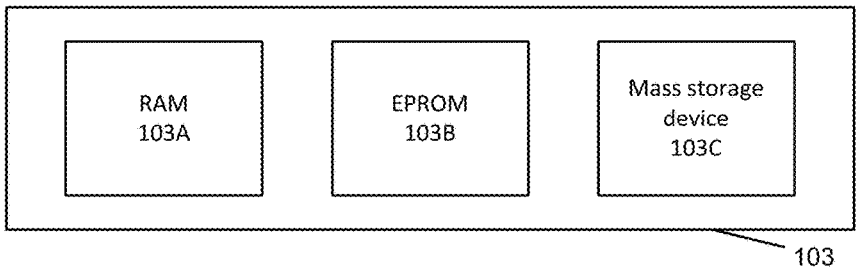
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
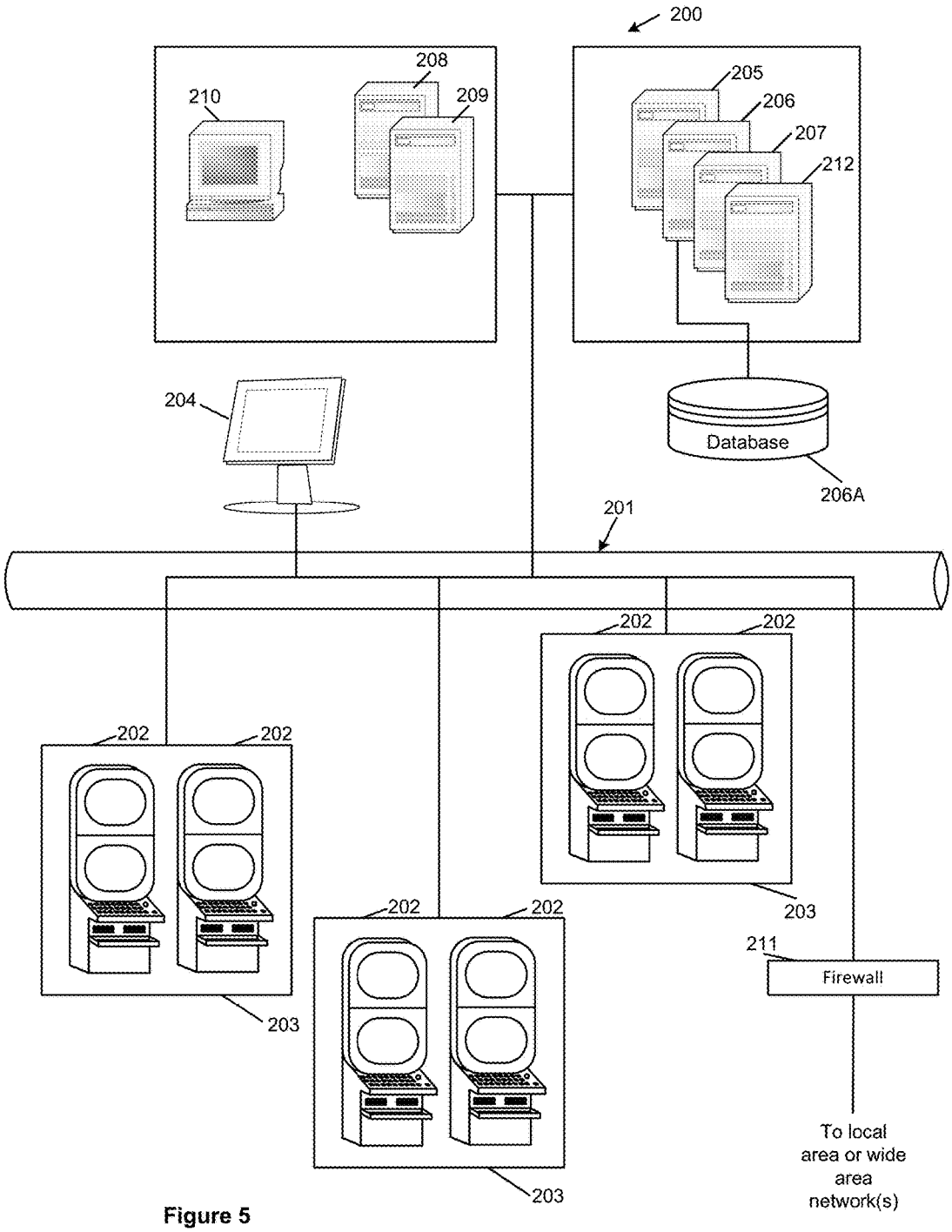
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

Figure 6:
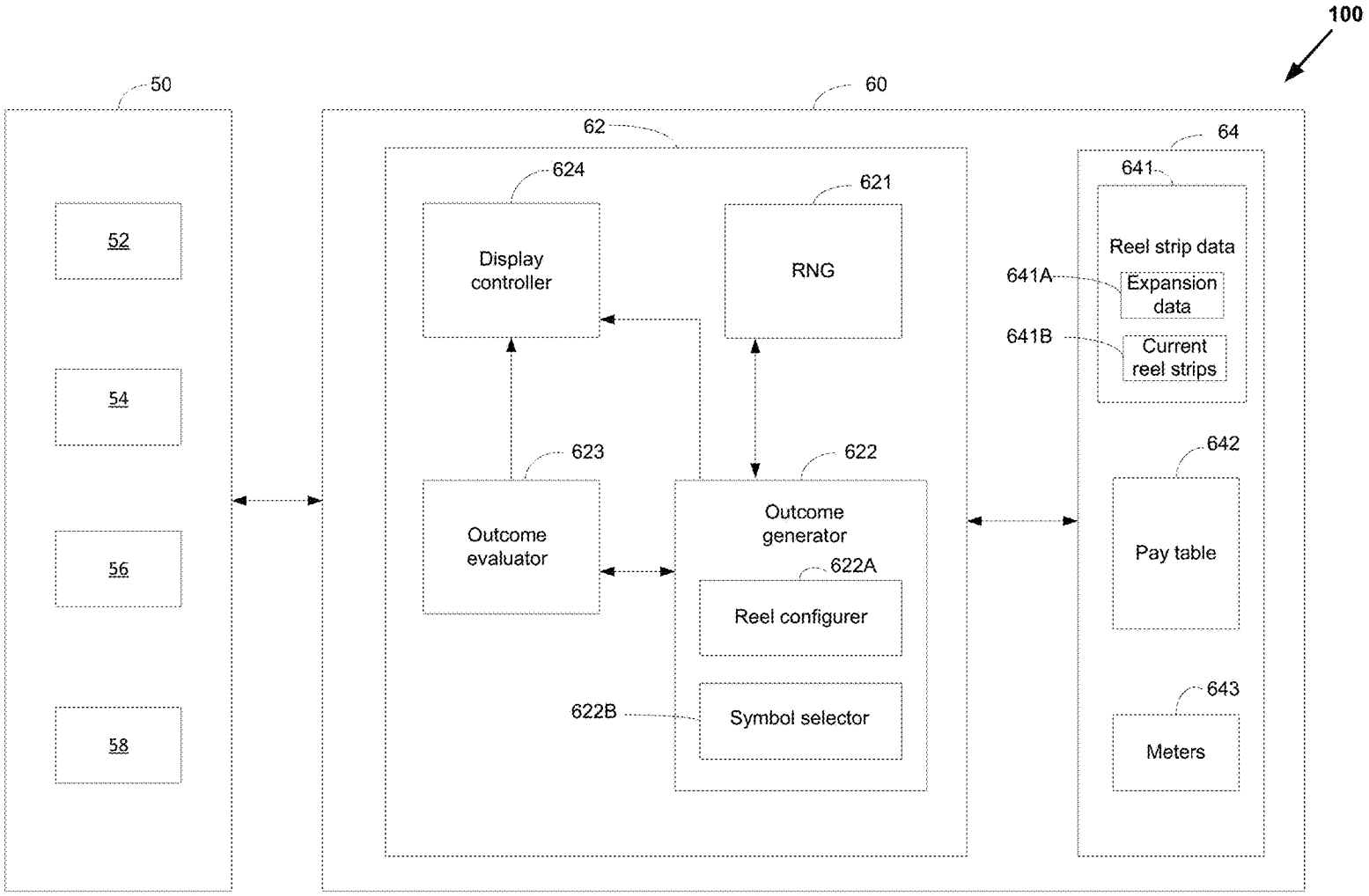
FIG. 6 is a further block diagram of a gaming system.

In FIG. 6, the processor 62 of game controller 60 of gaming system 1 is shown implementing a number of modules based on program code and data stored in memory 64. Persons skilled in the art will appreciate that one or more of the modules could be implemented in some other way, for example by a dedicated circuit.

The gaming system has a game play mechanism that allows the player to place a wager. The game play mechanism 56 enables a player to specify a wager which will be evaluated for this play of the game and initiates a play of the game. A player's wager can be varied from game to game dependent on player selections. In most spinning reel games, it is typical for the player's wager to be made up of a selection as to how the game outcome will be evaluated by specifying what parts of the game outcome will qualify for winning outcomes and a multiplier that will apply to each winning outcome. In an embodiment, a player's wager may be based on how many lines they play in each game—e.g. a minimum of one line up to the maximum number of lines allowed by the game (noting that not all permutations of win lines may be available for selection) and an amount per line—e.g. one, two or five credits. Winning outcomes on an activated win line may be evaluated based on a pay table that specifies the amount awarded for a one credit per line wager multiplied by the amount wagered per line.

Such win lines are typically formed by a combination of symbol display positions, one from each reel, the symbol display positions being located relative to one another such that they form a line.

In some embodiments, the gaming machine may award winning outcomes which are not on the lines they have selected, for example, "scatter" pays are awarded independently of a player's selection of pay lines.

In other embodiments, the game play mechanism may enable the player to select a number of reels to play and an amount to wager per reel. Games of this type are marketed under the trade name "Reel Power" by Aristocrat Leisure Industries Pty Ltd and are also known as "ways" to win games. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reels, the active display positions being all display positions of each selected reel and the designated display position of the non-selected reels. As a result for five reels and fifteen display positions there are 243 ways to win.

The reel configurer 622A of outcome generator 622 operates in response to the player's operation of game play mechanism 56 to place a wager and initiate a play of the game by configuring the reel strips for the current play of the game. In the embodiment, expansion data 641A defines at least one possible expansion of at least one reel strip position of least one of the reel strip. In another embodiment, expansion data 641A defines a plurality of possible expansions for a reel strip position. In another embodiment, expansion data 641A defines at least one possible expansion for a plurality of reels strip positions of a reel. In another embodiment, expansion data 641A defines at least one expansion for a plurality of the reels.

In an embodiment, the expansion data of a respective symbol display position comprises a probability table in which different probabilities are assigned to different numbers of symbols being added to the reel strip. In an embodiment, one of the probabilities is assigned to no symbols being added so that one possible outcome is that the reel will not be expanded. One example, of a probability table is shown below in Table 1.

TABLE 1

| Number of symbols to be added<br>Number of symbols to be added | Probability<br>Probability |
|---|---|
| 0 | 0.4 |
| 1 | 0.3 |
| 2 | 0.2 |
| 3 | 0.1 |

In an embodiment, reel configurer 622A carries out a random trial using random number generator 621 for each probability table of expansion data 641 to determine which reel strip positions should be expanded. For each reel strip position where one or more symbols are to be added, the reel strip configurer 622A adds a reel strip position to the reel between the relevant reel strip position and the neigbouring reel strip positions and populates it with the symbol from the relevant reel strip position to thereby form current reel strips 641B which will be used at least for a base game of the current play of the game.

Once the symbols selector 622B selects symbols from the current reel strips 641B using random number generator 621. The selected symbols are advised to the display controller 624 which causes them to be displayed on display 54 at a set of display positions.

In an embodiment, the symbol selector 622B selects the symbols for display by selecting a stopping position in the sequence. In one example, three symbols of each of five reels are displayed such that symbols are displayed at fifteen display positions on display 54.

Once the symbols are displayed, the outcome evaluator 623 determines in respect of the displayed symbols whether the lines the player has wagered on include any winning outcomes defined in pay table 642 and makes any awards for winning outcomes by crediting an award in credits to win meter of meters 643.

In another embodiment, the game controller is configured to display the expansion once the symbols are displayed on display 54. Taking an example where two symbols are added based on the symbol at reel strip position 12 of one of the reels in modified positions 13 and 14, and position 12 is selected to appear in the top position, the game controller may initially control the display to display the symbols originally found at positions 13 and 14 (which will now be at modified positions 15 and 16), and then animate the display to show expansion of the reel strip to show the two symbols that have been inserted at modified positions 13 and 14.

In some embodiments, an eligibility criteria may be applied for the player to be eligible for expansion, for example that the player has made a certain sized wager, made an ante bet, selected all win lines, played sufficient games, or the player is a member of a loyalty program. In some embodiments, different eligibility criteria may apply to different numbers of evaluations being carried out in respect of expansions. For example, a first wager may entitle the player to half of the expansions being evaluated while a second wager entitles the player to all the expansions being evaluated.

In other embodiments, there may be other expansion conditions that need to be met in order for one, more than one or all of the expansions to be evaluated by the reel configurer 622A. In one embodiment, there may be a random evaluation that controls the number of expansions that are evaluated. In another example, expansions may be associated with a number of different symbols and an evaluation may determine the symbol for which expansions will be calculated, for example all Aces or all Kings.

The base game is a part of the game which is carried out each time the player makes a wager, typically irrespective of the wager, whereas other parts of the such as a feature game will only be carried out occasionally for example if a condition is met such as a trigger occurring or if an ante bet is placed (depending on the specific embodiment).

Persons skilled in the art will appreciate that a feature game involves some additional element of game play which usually only occurs when a trigger condition is met. Types of feature games include: those where a series of free game events are awarded such as free games or re-spins (where some reels are held while others are re-spun); games where the symbols on the reel are changed; and "second screen" games where game play is totally different to the base game, for example where the player makes selections in a "pick a box type" game.

Figure 7:
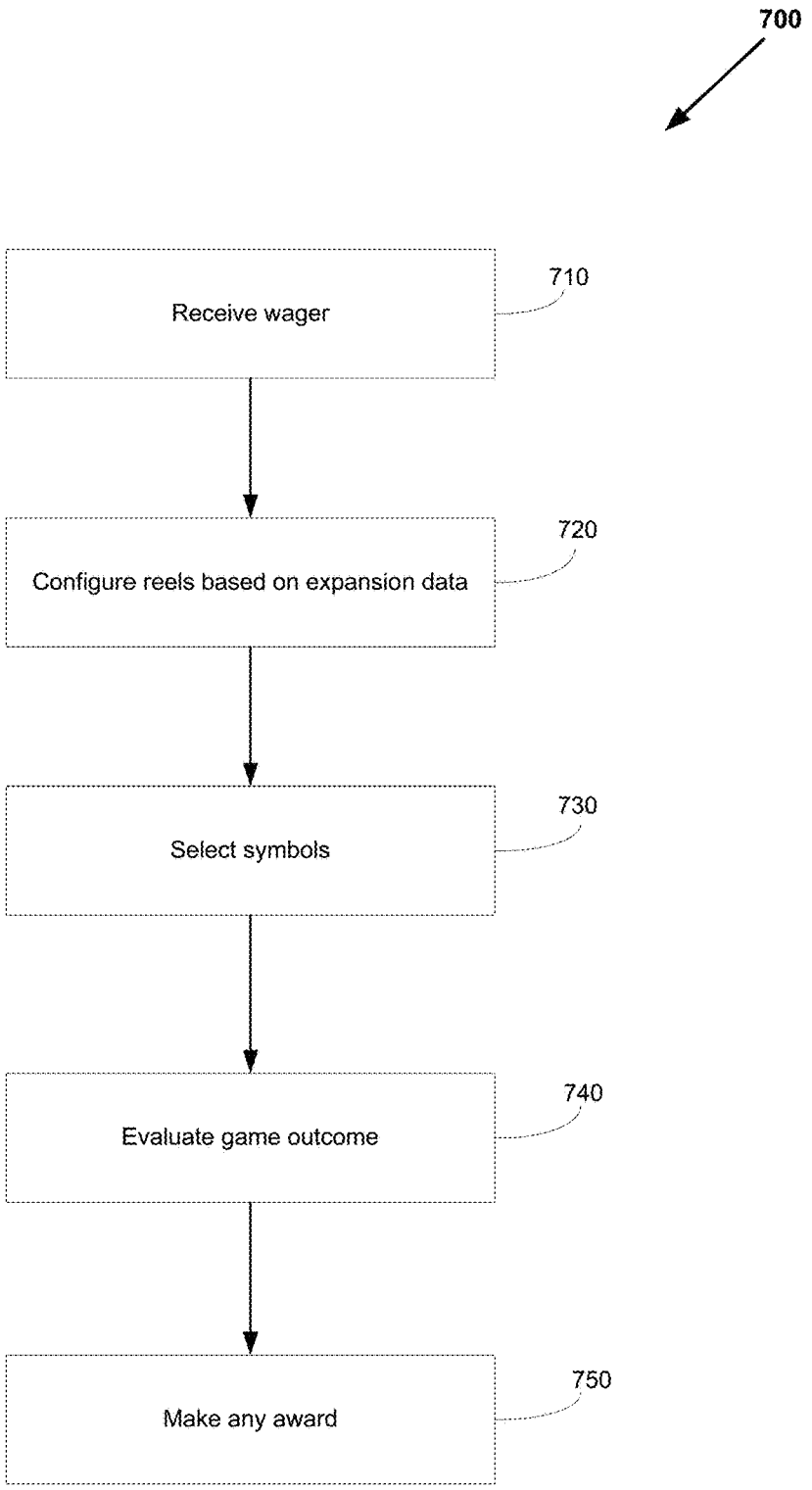
FIG. 7 is a flow chart of an embodiment.

FIG. 7 summarises the method 700 of the embodiment. The method involves, receiving 710 a wager, configuring 720 the reels based on expansion data, selecting 730 symbols for display on display 54 from the configured reels strips, evaluating 740 the selected symbols, and making 750 any awards by crediting the win meter.

EXAMPLES

Example 1

Reel 1 is 10 symbols long. On position 2 of that reel strip is an "ACE". If that symbol is chosen randomly to be spun up, that ACE can expand 1, 2, 3, . . . x positions long.

So when it expands, the reel strip length also expands. If in this example it expands to 3 symbols long, the reel strip now is 12 symbols long. The size of the expansion to the reel strip is determined by a weighting table.

Example 2

FIG. 8 shows a reel strip before (FIG. 8A) and after (FIG. 8B) expansion. As shown in FIG. 8A, the ACEs and positions 1 and 8 of the original reel strip can expand according to the weighting table of Tables 2 and 3. In Tables 2 and 3, the probability is expressed relative to the number of symbols which will be displayed, accordingly in Table 2 the weighting 0.1 allocated against the entry for one Ace represents the probability that there will be no expansion of the reels.

TABLE 2

| Number of "A"s to add for reel position 1 | Weighting |
|---|---|
| 1 | 0.1 |
| 2 | 0.2 |
| 3 | 0.5 |
| 4 | 0.2 |

TABLE 3

| Number of "A"s to add for reel position 8 | Weighting |
|---|---|
| 1 | 0.1 |
| 2 | 0.2 |
| 3 | 0.5 |
| 4 | 0.2 |

In the example illustrated in FIG. 8B, two symbols have been added by the reel configurer 622A based on the expansion data associated with position 1 and three symbols have been added based on the expansion data associated with position 8.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention. In particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A gaming system comprising:

a credit input mechanism configured to receive a physical item associated with a monetary value for establishing a credit balance, the credit balance being increasable and decreasable based on wagering activity;

a wagering input mechanism configured to allow a player to place one or more wagers using the credit balance;

a display configured to display selected symbols in a plurality of columns of display positions corresponding to respective ones of a plurality of reels;

a random number generator;

a memory storing reel strip data for each of the plurality of reels, the reel strip data specifying a sequence of reel strip positions and a symbol associated with each reel strip position, the reel strip data of at least one reel of the plurality of reels including expansion data separately associated with respective ones of the reel strip positions, the expansion data for each respective reel strip position defining a plurality of expansions, each of the plurality of expansions for a respective reel strip position defining a different number of reel strip positions to be added to the reel strip adjacent to the respective reel strip position, each added reel strip position having the same symbol as the respective reel strip position with which the expansion data is associated, each of the plurality of expansions for a respective reel strip position having an expansion probability that the respective expansion will occur, wherein at least two of the expansion probabilities for each respective reel strip position are different from one another; and a game controller configured to:

initiate a casino wagering game in response to receiving a wager input from the wager input mechanism, the wager input indicative of a wager amount that is deducted from the credit balance;

retrieve from the memory reel strip data for each of a plurality of reels, the retrieved data including expansion data for at least one reel strip position;

employ the random number generator to determine, based on the retrieved expansion data, whether to apply an expansion with respect to at least one reel strip position, including determining a number of reel strip positions to be added, and upon determining to apply the expansion:

add the determined number of reel strip positions between the symbol at least one reel strip position and an adjacent reel strip position to form an expanded reel strip, select symbols from the reel strips including the expanded reel strip using the random number generator, control the display to display the selected symbols in the display positions, and make an award upon the selected symbols including one or more winning symbol combinations, the award being added to the credit balance.

2. A gaming system as claimed in claim 1, wherein the game controller is configured to control the display to display at least part of the reel strip as expanding on the display upon a symbol being selected from an expanded portion of the reel strip.

3. A gaming system as claimed in claim 1, wherein the reel strip data of each of the plurality of reels includes expansion data associated with reel strip positions of the respective reels.

4. A gaming system as claimed in claim 1, wherein all of the expansion probabilities for a respective reel strip position are different from one another.

5. A gaming system as claimed in claim 4, wherein the expansion probabilities for a respective reel strip position include a probability that no expansion occurs.

6. A gaming system as claimed in claim 5, wherein the expansion probability that no expansion occurs is greater than any of the other expansion probabilities for a respective reel strip position.

7. A gaming system as claimed in claim 1, wherein the expansion probabilities for a respective symbol decrease as the number of reel strip positions to be added increases.

8. A gaming system as claimed in claim 1, wherein the game controller is configured to employ at least one eligibility criteria to determine whether to apply an expansion.

9. A gaming system as claimed in claim 8, wherein the at least one eligibility criteria comprise a wager.

10. A gaming system as claimed in claim 9, wherein a first wager entitles evaluation of a portion of the expansion data and a second wager entitles evaluation of all of the expansion data.

11. A method of operating a gaming system comprising, a credit input mechanism, a wager input mechanism, a display, a random number generator, a memory and a controller, the credit input mechanism being configured to receive a physical item associated with a monetary value for establishing a credit balance, the credit balance being increasable and decreasable based on wagering activity, the wager input mechanism configured to allow a player to place one or more wagers using the credit balance, the display configured to display selected symbols in a plurality of columns of display positions corresponding to respective ones of a plurality of reels, the method comprising:

storing reel strip data on said memory for each of the plurality of reels, the reel strip data specifying a sequence of reel strip positions and a symbol associated with each reel strip position, the reel strip data of at least one reel of the plurality of reels including expansion data separately associated with respective ones of the reel strip positions, the expansion data for each respective reel strip position defining a plurality of expansions, each of the plurality of expansions for a respective reel strip position defining a different number of reel strip positions to be added to the reel strip adjacent to the respective reel strip position, each added reel strip position having the same symbol as the respective reel strip position with which the expansion data is associated, each of the plurality of expansions for a respective reel strip position having an expansion probability that the respective expansion will occur, wherein at least two of the expansion probabilities for each respective reel strip position are different from one another; and initiating, via the controller, a casino wagering game in response to receiving a wager input from the wager input mechanism, the wager input indicative of a wager amount that is deducted from the credit balance;

employing the random number generator to determine, based on the expansion data, whether to apply the expansion with regard to at least one reel strip position, including determining a number of reel strip positions to be added adjacent to the at least one reel strip position; and upon determining to apply the expansion:

adding the number of reel strip positions between the at least one reel strip position and an adjacent reel strip position to form an expanded reel strip, selecting symbols from the reel strips including the expanded reel strip using the random number generator, controlling the display to display the selected symbols in a plurality of columns of display positions corresponding to respective one of the plurality of reels, and making an award upon the selected symbols including one or more winning symbol combinations, the award being added to the credit balance.

12. A method as claimed in claim 11, comprising controlling the display to display at least part of the reel strip as expanding on the display upon a symbol being selected from an expanded portion of the reel strip.

13. A method as claimed in claim 11, wherein the reel strip data of each of the plurality of reels includes expansion data associated with reel strip positions of the respective reels.

14. A method as claimed in claim 11, wherein all of the expansion probabilities for a respective reel strip position are different from one another.

15. A method as claimed in claim 14, wherein the expansion probabilities for a respective reel strip position include a probability that no expansion occurs.

16. A method as claimed in claim 15, wherein the expansion probability that no expansion occurs is greater than any of the other expansion probabilities for a respective reel strip position.

17. A method as claimed in claim 11, wherein the expansion probabilities for a respective symbol decrease as the number of reel strip positions to be added increases.

18. A method as claimed in claim 11, wherein the game controller is configured to employ at least one eligibility criteria to determine whether to apply an expansion.

19. A method as claimed in claim 18, wherein the at least one eligibility criteria comprise a wager.

20. A method as claimed in claim 19, wherein a first wager entitles evaluation of a portion of the expansion data and a second wager entitles evaluation of all of the expansion data.

21. A gaming machine configured for playing a reel-type wagering game, the gaming machine comprising:

a gaming cabinet configured to house components associated with the gaming machine;

a wagering input mechanism coupled to the gaming cabinet and configured to allow a player to place one or more wagers using the credit balance;

a display coupled to the gaming cabinet and configured to display selected symbols in a plurality display positions, the display positions being arranged in columns where each column corresponds to respective ones of a plurality of reels;

a random number generator within the gaming cabinet;

a memory within the gaming cabinet and configured to store reel strip data for each of the plurality of reels, the reel strip data specifying a sequence of reel strip positions and a symbol associated with each reel strip position, the reel strip data of at least one reel of the plurality of reels including expansion data separately associated with respective ones of the reel strip positions, the expansion data for each respective reel strip position defining a plurality of expansions, each of the plurality of expansions for a respective reel strip position defining a different number of reel strip positions to be added to the reel strip adjacent to the respective reel strip position, each added reel strip position having the same symbol as the respective reel strip position with which the expansion data is associated, each of the plurality of expansions for a respective reel strip position having an expansion probability that the respective expansion will occur, wherein at least two of the expansion probabilities for each respective reel strip position are different from one another;

a game controller within the cabinet and configured to:

initiate a casino wagering game in response to receiving a wager input from the wager input mechanism, the wager input indicative of a wager amount that is deducted from the credit balance;

retrieve data from the memory reel strip data for each of a plurality of reels, the retrieved data including expansion data for at least one reel strip position;

employ the random number generator to determine based on the expansion data whether to apply an expansion with respect to the at least one reel strip position, including determining a number of positions to be added adjacent to said at least one reel strip position, and upon determining to apply the expansion:

add the determined number of reel strip positions between the at least one reel strip position and an adjacent reel strip position to form an expanded reel strip, select symbols from the reel strips including the expanded reel strip using the random number generator, control a display of the gaming system to display the selected symbols in a plurality of columns of display positions corresponding to respective ones of the plurality of reels, and make an award upon the selected symbols including one or more winning symbol combinations, the award being added to the credit balance; and a payout mechanism coupled to the gaming cabinet and configured to make a payout from the credit balance.

22. A gaming machine as claimed in claim 21, wherein the game controller is configured to control the display to display at least part of the reel strip as expanding on the display upon a symbol being selected from an expanded portion of the reel strip.

23. A gaming machine as claimed in claim 21, wherein the reel strip data of each of the plurality of reels includes expansion data associated with reel strip positions of the respective reels.

24. A gaming machine as claimed in claim 21, wherein all of the expansion probabilities for a respective reel strip position are different from one another.

25. A gaming machine as claimed in claim 24, wherein the expansion probabilities for a respective reel strip position include a probability that no expansion occurs, and wherein the expansion probability that no expansion occurs is greater than any of the other expansion probabilities for a respective reel strip position.

26. A gaming machine as claimed in claim 21, wherein the expansion probabilities for a respective symbol decrease as the number of reel strip positions to be added increases.

27. A gaming machine as claimed in claim 21, wherein the game controller is configured to employ at least one eligibility criteria to determine whether to apply an expansion.

28. A gaming machine as claimed in claim 27, wherein the at least one eligibility criteria comprise a wager.

29. A gaming machine as claimed in claim 28, wherein a first wager entitles evaluation of a portion of the expansion data and a second wager entitles evaluation of all of the expansion data.

* * * * *